US007658683B1

(12) United States Patent
Daniel

(10) Patent No.: US 7,658,683 B1
(45) Date of Patent: Feb. 9, 2010

(54) GULF PUTTING TRAINING AID

(76) Inventor: Albert Scott Daniel, 4624 Rutgers Rd., Mobile, AL (US) 36619

( * ) Notice: Subject to any disclaimer, the term of this patent is extended or adjusted under 35 U.S.C. 154(b) by 67 days.

(21) Appl. No.: 11/901,527

(22) Filed: Sep. 18, 2007

Related U.S. Application Data

(63) Continuation-in-part of application No. 11/185,490, filed on Jul. 21, 2005, now abandoned.

(51) Int. Cl.
*A63B 53/16* (2006.01)

(52) U.S. Cl. ..... 473/294

(58) Field of Classification Search ..... 473/201, 473/226, 231, 293–295, 298–299; D21/791, D21/756

See application file for complete search history.

(56) References Cited

U.S. PATENT DOCUMENTS

| | | | | | |
|---|---|---|---|---|---|
| 760,161 | A | * | 5/1904 | Smith | 473/294 |
| 1,919,221 | A | * | 7/1933 | Janes | 473/294 |
| 2,273,416 | A | | 2/1942 | Norwood | |
| 2,801,875 | A | | 8/1957 | McEvoy | |
| 3,951,416 | A | | 4/1976 | Koch et al. | |
| 3,963,244 | A | * | 6/1976 | Mierzejewski | 473/293 |
| 4,819,944 | A | * | 4/1989 | Doane | 473/256 |
| 4,944,516 | A | | 7/1990 | Bickler | |
| 5,037,103 | A | * | 8/1991 | Williams et al. | 473/294 |
| 5,106,095 | A | * | 4/1992 | Pitkethly | 473/201 |
| 5,220,742 | A | | 6/1993 | Lewis | |
| 5,388,834 | A | * | 2/1995 | Dawson | 473/211 |
| D356,135 | S | * | 3/1995 | Slusher | D21/759 |
| 5,520,392 | A | | 5/1996 | Foresi et al. | |
| 5,810,675 | A | | 9/1998 | Weathers | |
| D407,455 | S | * | 3/1999 | Dolce | D21/756 |
| 5,890,977 | A | | 4/1999 | Taylor | |
| 6,071,199 | A | * | 6/2000 | Suzuki | 473/294 |
| 6,491,591 | B1 | | 12/2002 | Schuster | |
| 6,533,676 | B1 | | 3/2003 | D'Angelo et al. | |
| D557,760 | S | * | 12/2007 | Higgins | D21/791 |

* cited by examiner

*Primary Examiner*—Stephen L. Blau
(74) *Attorney, Agent, or Firm*—George L. Williamson

(57) ABSTRACT

Apparatus and method for a golf putting training aid, which is attached to the shaft of a conventional existing putter which putter would normally be used by the golfer for putting. The apparatus comprises a second handle, which is disposed parallel to the first handle of the existing putter, wherein the apparatus has means of being attached to the shaft of the existing putter so that the second handle on the golf putting training aid is disposed parallel to the handle of the existing putter. The second handle is removable and can be moved along the first handle and the distance between the first and second handles can be varied.

7 Claims, 3 Drawing Sheets

GULF PUTTING TRAINING AID

RELATED APPLICATION

This application is a continuation-in-part of U.S. patent application Ser. No. 11/185,490 filed on Jul. 21, 2005 now abandoned.

BACKGROUND OF THE INVENTION

1. Field of the Invention

The present invention generally relates to golf training aids and, more particularly, is concerned with an apparatus and method for a golf putting training aid.

2. Description of the Prior Art

Golf training aids have been described in the prior art. However, none of the prior art devices disclose the unique features of the present invention.

U.S. Pat. No. 6,533,676 to D'Angelo, et al. dated Mar. 18, 2003 described a golf putting aid and brace member therefore. U.S. Pat. No. 6,491,591 to Schuster dated Dec. 10, 2002 described a putter stabilizing brace for putt training. U.S. Pat. No. 5,810,675 to Weathers dated Sep. 22, 1998 described a golf putting stroke training device. U.S. Pat. No. 5,520,392 to Foresi, et al. dated May 28, 1996 described a golf training device for teaching a pendulum-type putting swing. U.S. Pat. No. 4,944,516 to Bickler dated Jul. 31, 1990 described a putting trainer device. U.S. Pat. No. 3,951,416 to Koch, et al. dated Apr. 20, 1976 described a golf training device. U.S. Pat. No. 2,273,416 to Norwood dated Feb. 17, 1942 described a golf instruction device. U.S. Pat. No. 5,220,742 to Lewis dated Jun. 22, 1993 disclosed a rod-mounted case for fishing lures. U.S. Pat. No. 2,801,875 to McEvoy dated Aug. 6, 1957 disclosed a golf ball retriever. U.S. Pat. No. Des. 356,135 to Slusher dated Mar. 7, 1995 disclosed a golf swing training aid. U.S. Pat. No. 5,890,977 to Taylor dated Apr. 6, 1999 disclosed a golf putter alignment method. U.S. Pat. No. 6,071,199 to Suzuki dated Jun. 6, 2000 disclosed a method for correction of golf swing. U.S. Pat. No. 760,161 to Smith dated May 17, 1904 disclosed an attachment for a golf club handle.

While these golf training aids may be suitable for the purposes for which they were designed, they would not be as suitable for the purposes of the present invention, as hereinafter described.

SUMMARY OF THE INVENTION

Apparatus and method for a golf putting training aid, which is attached to the shaft of a conventional existing putter which putter would normally be used by the golfer for putting. The apparatus comprises a second handle, which is disposed parallel to the first handle of the existing putter, wherein the apparatus has means of being attached to the shaft of the existing putter so that the second handle on the golf putting training aid is disposed parallel to the handle of the existing putter. The second handle is removable and can be moved along the first handle and the distance between the first and second handles can be varied.

An object of the present invention is to provide a golf putting training aid, which is designed to assist a golfer in learning how to properly putt a golf ball. Another object of the present invention is to aid a golfer in overcoming a habit of cocking or breaking the wrist of the user as the user swings his arm through the putting stroke. Another object of the present invention is to provide a golf putting training aid which is portable and can be easily carried about by a user. A further object of the present invention is to provide a golf putting training aid which can be easily attached to any putter which may be available to the user. Another object of the present invention is to provide a golf putting training aid which can be easily and relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
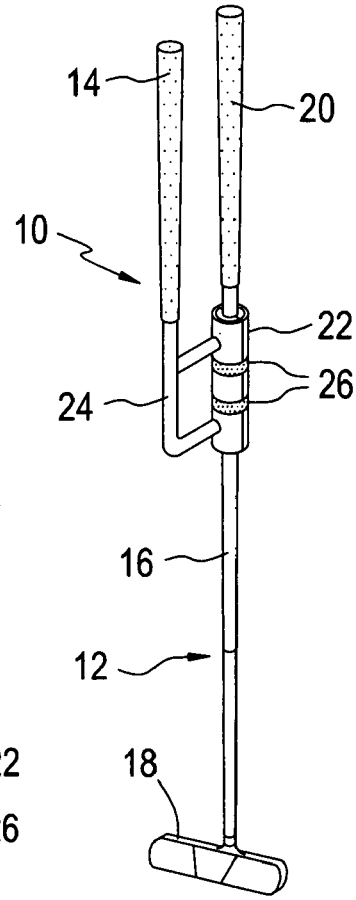
FIG. 1 is a perspective view of the present invention shown in operative connection.
Figure 2:
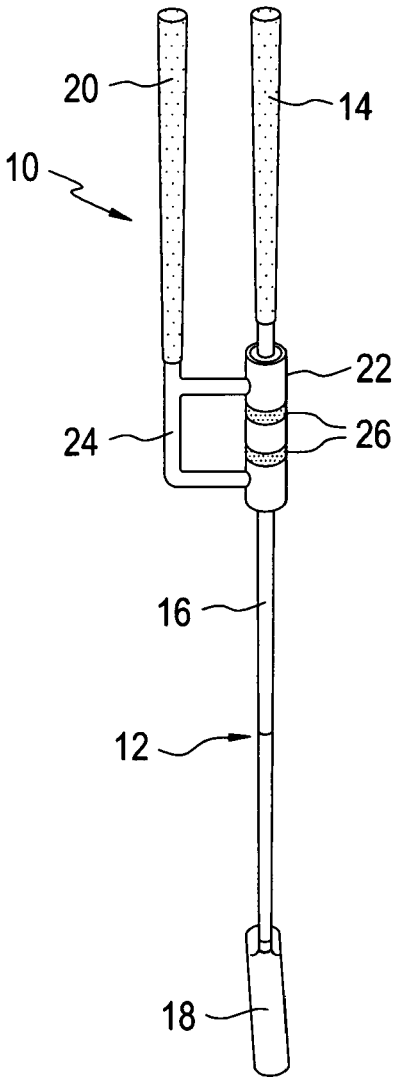
FIG. 2 is a perspective view of the present invention shown in operative connection.
Figure 3:
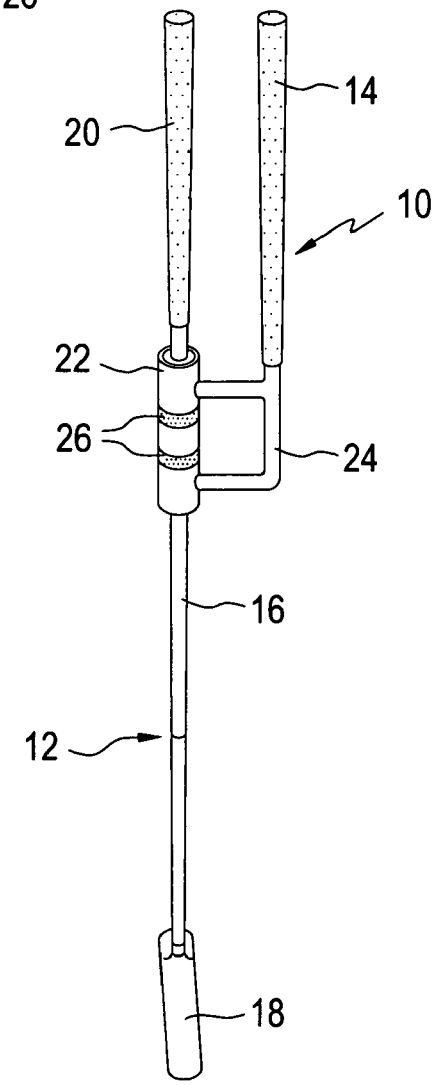
FIG. 3 is a perspective view of the present invention shown in operative connection.
Figure 4:
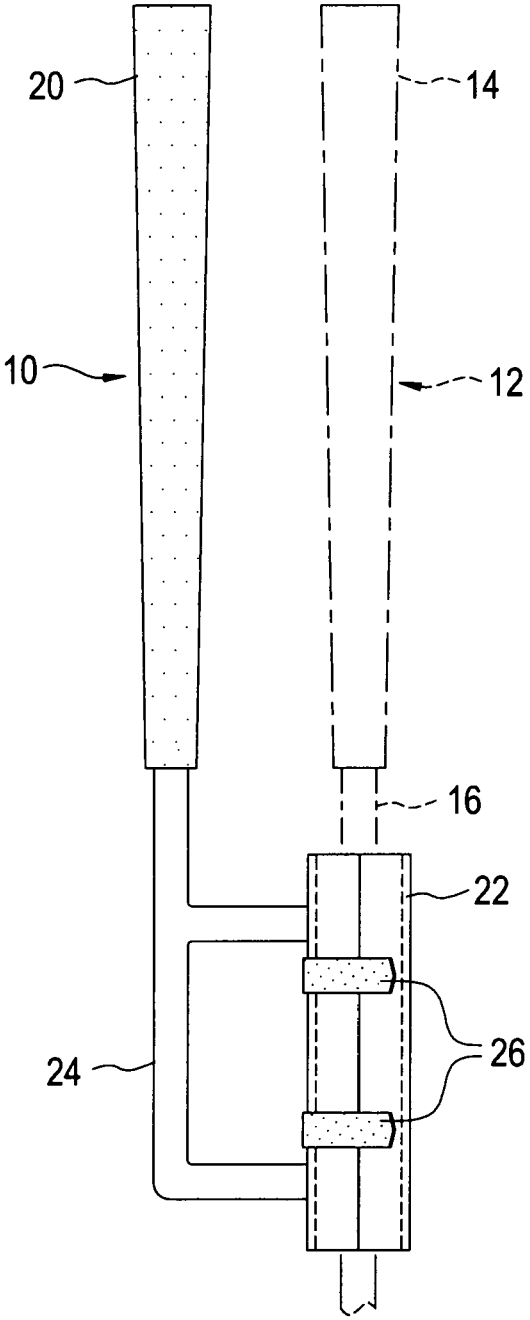
FIG. 4 is an elevation view of portions of the present invention shown in operative connection.

With regard to reference numerals used, the following numbering is used throughout the drawings.

10 present invention
12 existing putter
14 handle of existing putter
16 shaft of existing putter
18 head of existing putter
20 handle of present invention
22 connecting means
24 connecting frame
26 straps
28 cavity
30 foam
32 housing
34 hinge
36 throughbore
38 connecting cross frame member
40 connecting cross frame member
42 male cross frame member
44 female cross frame member
46 locking member
48 collar
50 mating threads
52 first end
54 second end

DETAILED DESCRIPTION OF THE PREFERRED EMBODIMENT

Turning now descriptively to the drawings, in which similar reference characters denote similar elements throughout the several views, FIGS. 1 through 8 illustrate the present invention wherein a golf putting training aid is disclosed.

Turning to FIGS. 1-4, therein are shown the present invention 10 in operative connection with an existing golf putter 12. The conventional existing putter 12 has a handle 14, shaft 16 and a putting head 18. The present invention 10 has a handle 20 and a connecting means 22 for being securely removably attached parallel to the shaft or handle of the existing putter 12. The present invention 10 also has a connecting frame means 24 for connecting the handle 20 to the connection means 22. Also shown are hook and loop material straps 26 for securing connecting means 22 about the putter shaft 16.

Figure 5:
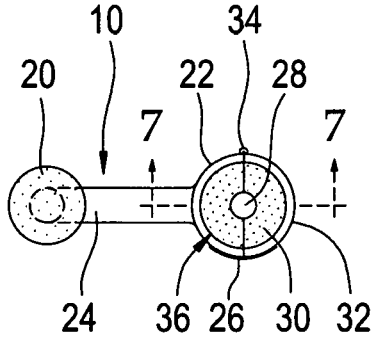
FIG. 5 is a sectional view of the present invention.
Figure 6:
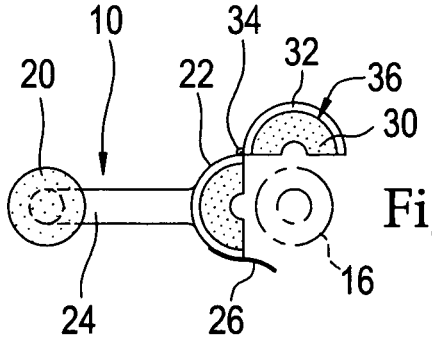
FIG. 6 is a sectional view of the present invention.
Figure 7:
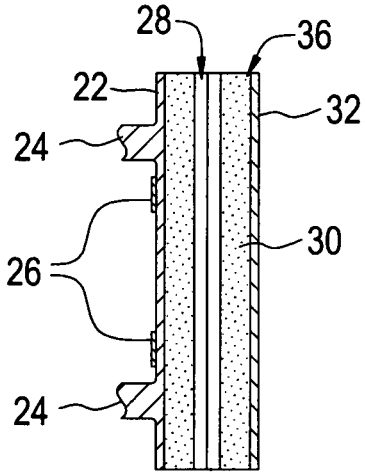
FIG. 7 is a sectional view of the present invention.

Turning to FIGS. 5, 6 and 7, therein are shown the connecting means 22 for attaching the present invention 10 to the shaft 16 of the existing golf putter whereby the present invention can be moved along the shaft of the existing putter an effective distance to reach a comfortable level or the desired position of the user in substantially the vertical plane. Shown is the handle 20 of the present invention 10 along with the connecting frame 24, which connects the present invention to the connecting means 22. Frame 24 has one of its ends connected to the handle 20 and the other end connected to the handle 14. It can be seen that connecting means 22 actually comprises a cylindrical housing 32 with longitudinal halves that are hingedly connected at 34 so that the each half of the housing 32 can be removably secured to each other using the Velcro (hook and loop material) strap 26. Housing 32 has a throughbore 36 therein. In FIG. 5 it can be seen that the throughbore 36 of connecting means 22 has an internal foam member 30 disposed internal the housing 32 having a cavity or central bore 28 therein which is designed to receive the shaft 16 of an existing golf putter. Connecting means 22 has foam member 30 therein which is removably attached about the shaft of the existing golf putter. FIG. 5 shows the housing 32 in a closed position with the strap 26 securing the two portions of the housing 32 together. FIG. 6 shows the housing 32 in open position ready to receive the shaft 16 of the existing putter therein. FIG. 7 shows the housing 32 along with the cavity 28 and foam 30.

Figure 8:
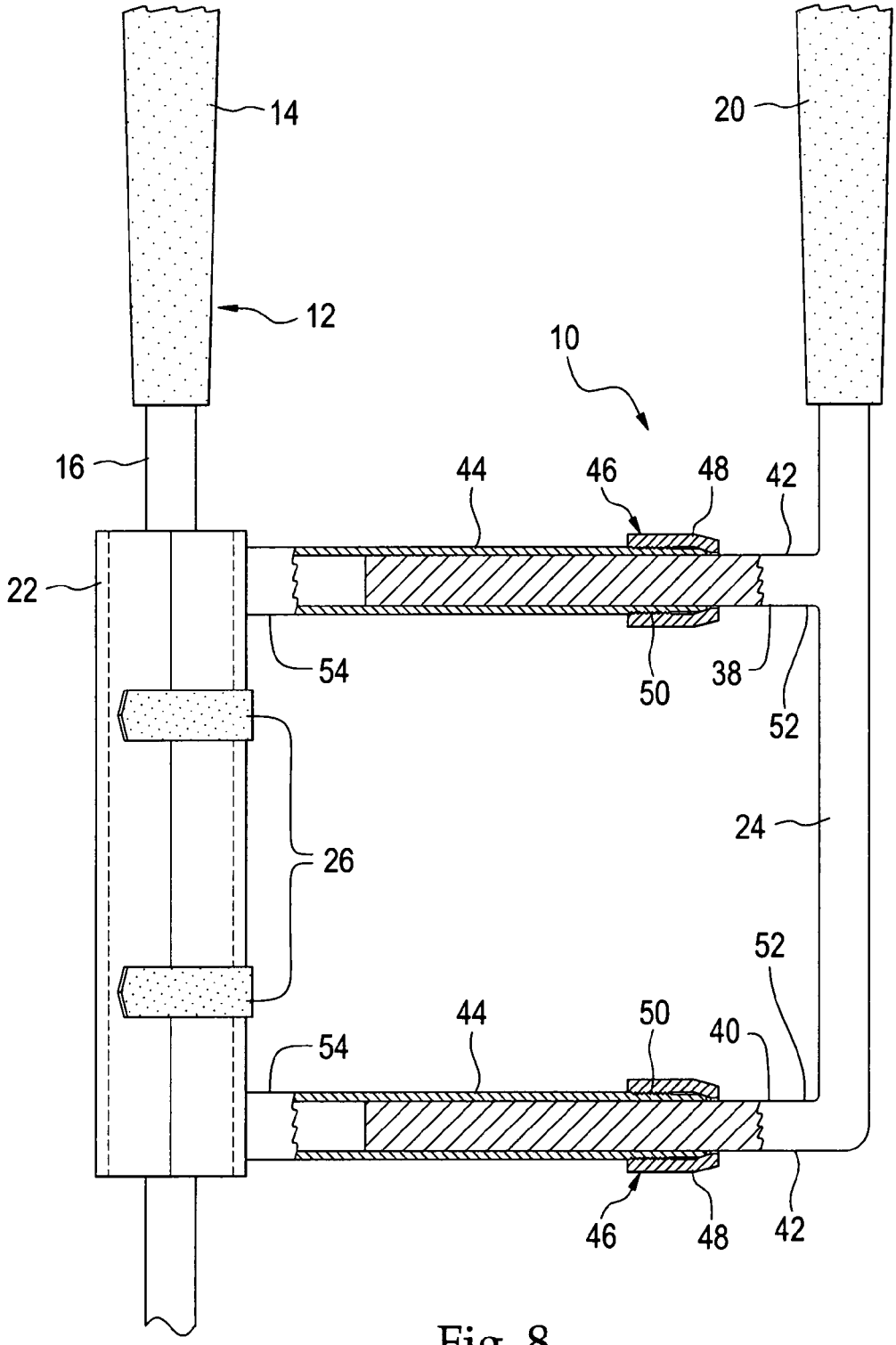
FIG. 8 is an elevation with partial-sectional view of portions of the present invention shown in operative connection.

Turning to FIG. 8, therein is shown existing putter 12 with handle 14, and shaft 16. The present invention 10 has a handle 20 and a connecting means 22 for being securely removably attached parallel to the shaft or handle of the existing putter 12. The present invention 10 also has a connecting frame means 24 for connecting the handle 20 to the connection means 22. Also shown are hook and loop material straps 26 for securing connecting means 22 about the putter shaft 16. Also shown are means for a connecting cross frame member 38, 40 each having telescoping male 42 and female 44 cross frame members each having an exemplary frictional locking member 46 thereon comprising a rotatable collar 48 and mating threads 50 which allows the distance between handles 14 and 20 to be varied an effective distance by sliding the male member within the female member and then tightening the locking member to secure the cross frame members and thereby secure the handles with respect to the distance between each other. Each connecting cross frame member 38, 40 has a first end 52 and a second end 54. When the collar is loosened by rotation the male and female cross frame members 42, 44 can be moved with respect to each other to a user selectable position and then the collar can be tightened by rotation so that the male and female members are locked in place. Having the horizontal distance between the handles 14, 20 be variable an effective distance allows the user to position the handles with respect to each other an effective distance apart so as to be more comfortable to the user and to maximize the training experience provided by the present invention. Having the handles 14, 20 be further apart emphasizes the breaking of the wrist so as to train the user not to break the wrist and then as the user improves his stoke he can reposition the handles to be closer together to maintain the improved stroke.

The present invention was developed while trying to teach a student how to putt a golf ball. The student would repeatedly break (or cock) his wrist on the putting stroke. It is known that in putting this can be very detrimental. The purpose of a putting stroke is to be repeatable over and over so that the player will know how the ball is going to react after being hit.

The best way to do this, is make the swing as simple as possible, and the most accepted way uses the principle of a pendulum. A proper stroke starts from a point above the ball, wherein the shoulders and arms form a straight line down to the ball, comprising the arms and the club. The arms and club should move back and forth in a straight line and strike the ball in a repeatable particular direction. By breaking the wrist the club face is opened, thereby changing the direction in which the ball will go, while simultaneously the speed of the club has changed altering the distance the ball will travel, and possibly the path of the club has been changed, meaning that even if the open face and the speed of the club head happen to get back to the original starting spot with a change in direction the ball will still go either left or right of the target.

In practice, the present invention is attached to a user's putter and it provides another putter grip to use. There are now two grips to use, one for each hand. For example, the left hand would be holding the original putter grip and the right hand would be holding the extra grip of the present invention. By separating the hands, it was found that a wrist break produced a very awkward feeling. Just by swinging the club with the present invention attached, a user can make very good putting swings.

Another benefit of the present invention is that by swinging the club this way (using a right handed putter) a user feels as though he is dragging the club through the ball or hitting it with just the left hand. A user could change the sensation of the swing by simply reversing the present invention. A user now holds the original putter grip with the right hand and the present invention with the left, and the user will feel that he is pushing the ball more with the opposite or right hand. Both ways make the player acquire the feel that will be needed for delicate and precise putting. Neither way is right or wrong, because which ever makes the golfer feel more comfortable would give them more self confidence and help them make more putts. Also, in practice, the second handle, i.e., the present invention, can be disposed behind the first handle, i.e., the original, existing putter, or the first and second handles can be reversed, and, the second handle can be disposed in front of the first handle.

I claim:

1. An apparatus for putting training for attachment to an existing putter having a first handle thereon, comprising:

a) a second handle having first and second ends, wherein said second handle is disposed parallel to the first handle of the existing putter so that a user can grasp said first handle with a first hand and said second handle with a second hand;

b) a cylindrical member having a throughbore therein and first and second halves, wherein said first and second halves are separated by a longitudinal line disposed along said cylindrical member, wherein the existing putter is removably secured within said cylindrical member so that the second handle is removably attached to the first handle; and, c) first and second telescoping cross frame members, each said first and second telescoping cross frame members having first and second ends, wherein each said first end is connected to said second handle and each said second end is connected to said cylindrical member so that the distance between the first and second handles can be varied.

2. The apparatus of claim 1, wherein said second handle is disposed behind the first handle.

3. The apparatus of claim 1, wherein said second handle is disposed in front of the first handle.

4. The apparatus of claim 3, wherein said second handle of the apparatus is sized complementarily as the first handle of the existing putter.

5. The apparatus of claim 1, further comprising a foam member being disposed in said throughbore of said cylindrical member, said foam member having a cavity therein, wherein said foam member is removably disposed about the shaft of the existing putter so that the shaft of the existing putter is disposed in said cavity.

6. The apparatus of claim 5, further comprising a hinge mounted on said first and second halves of said cylindrical member so that said first and second halves can be opened and closed about the shaft of the existing putter.

7. The apparatus of claim 6, further comprising at least one hook and loop material member for removably securing said first and second halves to each other.

* * * * *